United States Patent [19]

Hamilton

[11] 4,116,167

[45] Sep. 26, 1978

[54] METHODS AND APPARATUS FOR HEATING A FLUID BY VAPOR CONDENSATION

[76] Inventor: Ralph A. Hamilton, 1836 Lake St., Glendale, Calif. 91201

[21] Appl. No.: 761,839

[22] Filed: Jan. 24, 1977

[51] Int. Cl.[2] ..... F22B 1/02; F22D 7/00

[52] U.S. Cl. ..... 122/33; 122/408 GT; 237/60

[58] Field of Search ..... 122/33, 156, 408 GT; 237/60

[56] References Cited

U.S. PATENT DOCUMENTS

| | | | |
|---|---|---|---|
| 823,488 | 6/1906 | Barnstead | 122/33 |
| 1,240,804 | 9/1917 | Alexander et al. | 122/408 |
| 1,987,182 | 1/1935 | Dalen et al. | 122/33 |
| 2,686,863 | 8/1954 | Chandler | 122/33 |
| 3,717,748 | 2/1973 | Imler | 237/60 |
| 3,759,230 | 9/1973 | Cooksley | 122/156 |
| 3,854,454 | 12/1974 | Lazaridis | 122/33 |

*Primary Examiner*—Kenneth W. Sprague

*Attorney, Agent, or Firm*—Ralph M. Flygare

[57] ABSTRACT

Methods and apparatus for heating and storing a fluid contain the fluid in a heat insulated space and prepare by heating of a heat transfer medium in a first region located at a distance from that space a vapor having a certain pressure and being condensable through transfer of heat to the contained fluid. A second region of a pressure lower than the mentioned vapor pressure is provided by heat transfer to the contained fluid in the mentioned space. The vapor is passed to the lower pressure second region into heat transfer relationship with, but physically separate from, the mentioned fluid and is converted by heat transfer to said fluid to a condensate in that lower pressure second region whereby the fluid is heated. The condensate is maintained physically separate from the fluid and is recycled from the second region to the first region. The recycled condensate is converted to vapor by reheating in the first region and the above mentioned cycle is continued until the fluid has been heated to a desired temperature.

13 Claims, 6 Drawing Figures

METHODS AND APPARATUS FOR HEATING A FLUID BY VAPOR CONDENSATION

BACKGROUND OF THE INVENTION

1. Field of the Invention

The subject invention relates to methods and apparatus for heating fluids and storing hot fluids and, more specifically, to methods and apparatus for heating fluids and storing hot fluids with the aid of vaporization and condensation of a heat transfer medium. By way of example, the subject invention relates to a water heater employing vaporization and condensation for heat transfer into a heat insulated storage tank of water.

2. Description of the Prior Art

By way of example, and not by way of limitation, it may be observed that the underlying concept of domestic water heating for all practical purposes has followed very much the same pattern for a century up to the present time. It is thus relatively easy to recognize the archetype of which the currently predominantly used water heater is a manifestation in such proposals as are apparent from U.S. Pat. No. 765,652, by P. A. Deasy, issued July 19, 1904, U.S. Pat. No. Re. 12,397, by P. A. Deasy, reissued Nov. 7, 1905, U.S. Pat. No. 1,719,015, by C. U. Levis, issued July 2, 1929, U.S. Pat. No. Re. 19,363, by O. W. Ott et al, issued Nov. 6, 1934, U.S. Pat. No. 2,322,488, by O. E. Uecker, issued June 22, 1943, U.S. Pat. No. 3,089,466, by W. W. Binger et al, issued May 14, 1963, U.S. Pat. No. 3,251,346, by A. Merino, issued May 17, 1966, and U.S. Pat. No. 3,707,142, by Shiro Kobayashi, issued Dec. 26, 1972. Interestingly, the above mentioned Deasy patents provided the water heater with a facility for supplying the water-back of a stove with hot water. This is somewhat related to the proposal in U.S. Pat. No. 765,651, by P. A. Deasy, issued also on July 19, 1904, according to which the actual heating of the water takes place outside the hot water storage tank.

The proposals in U.S. Pat. No. 1,822,871, by J. P. Morley, issued Sept. 8, 1931, constitute a mixture of the archetypal, presently most widely used water heater and of the type of heater wherein the heating takes place separately from the hot water storage tank. Reference may in this connection also be had to U.S. Pat. No. 189,421, by Joshua Bishop, issued Apr. 10, 1877, U.S. Pat. No. 1,830,933, by Alfred F. Coony, issued Nov. 10, 1931, U.S. Pat. No. 2,399,318, by J. W. Bouldin, issued Apr. 30, 1946, U.S. Pat. No. 2,563,817, by H. J. Carson, issued Aug. 14, 1951, U.S. Pat. No. 2,650,575, by A. W. Carlson, issued Sept. 1, 1953, and U.S. Pat. No. 2,684,054, by H. J. Carson, issued July 20, 1954.

These prior-art heaters are characterized by high losses and inefficiency, and the currently most widely used gas water heater has aggravated, rather than alleviated, the problem by its use of a central riser or chimney for the hot products or combustion. In principle, such central riser through the water tank enables the products of combustion of the heating process to help heating the water. However, in overall effect such a riser is detrimental since it provides an escape path for heat from the hot water in the tank during the long intervals between heating cycles.

In the case of designs wherein the heating of the water takes place at a distance from the tank, similar heat losses occur as to the water present in the heater part of the installation. Further heat losses are added when hot water is circulated, by convection, to the cooled heater and then back into the storage water tank. This action follows rather closely the detrimental cooling encountered in the above mentioned central riser type of water heater.

In power plants, ships and other special installations, steam has sometimes been used in heating water. For instance, steam has simply been issued into the water for heating purposes. In practice, this is a very wasteful process that would not be feasible for most typical water heating purposes. Alternatively, steam and condensate have been circulated through a closed system. Again, existing systems are rather wasteful and not usable in typical water heater environments.

SUMMARY OF THE INVENTION

It is a general object of this invention to overcome the above mentioned disadvantages and deficiencies.

It is a related object of this invention to provide improved methods and apparatus for heating fluids and storing heat fluids.

It is a germane object of this invention to provide improved methods and apparatus for heating fluids with the aid of vapor generation and vapor condensation.

It is also a germane object of this invention to reduce thermal losses and increase efficiency relative to comparable prior-art levels.

Other objects will become apparent in the further course of this disclosure.

From one aspect thereof, the subject invention resides in a method of heating and storing a fluid comprising, in combination, the steps of containing the fluid in a space, heat insulating that space, providing a vaporizable heat transfer medium, heating that heat transfer medium in a first region located at a distance from the mentioned space to generate from the heat transfer medium a vapor condensable through transfer of heat to the contained fluid and providing a vapor pressure in the first region, providing by heat transfer to the fluid in the mentioned space a second region of a pressure lower then vapor pressure in the first region, flowing the vapor to the lower pressure second region into heat transfer relationship with, but physically separate from, the fluid and converting the vapor to a condensate in the lower pressure second region by heat transfer to said fluid whereby the fluid is heated, maintaining the condensate physically separate from the fluid, recycling the condensate from the second region to the first region, converting the recycled condensate to vapor by reheating in the first region, continuing to provide a vapor pressure in the first region, continuing to provide by heat transfer to the fluid in the mentioned space a lower pressure second region, recycling the converted vapor from the first region to the second region into heat transfer relationship with, but physically separate from the fluid and reconverting the vapor to a condensate in the lower pressure second region by heat transfer to the fluid whereby the fluid is heated, maintaining the reconverted condensate physically separate from the fluid, and continuing to recycle condensate from the second region to the first region, to convert recycled condensate to vapor by reheating in the first region, to recycle converted vapor from the first region to the second region, and to reconvert vapor to condensate in the second region by heat transfer to the mentioned fluid until the fluid has attained a desired temperature.

From another aspect thereof, the subject invention resides in apparatus for heating and storing a fluid comprising, in combination, first means for containing and heat insulating the fluid, second means spaced from the first means for receiving and heating a vaporizable heat transfer medium to generate a vapor in a first region located at a distance from the contained fluid and to provide vapor pressure in the first region with that vapor, third means at the first means for providing by heat transfer to the contained fluid a second region of a pressure lower then the vapor pressure in the first region and for maintaining the second region physically separate from, but in heaat transfer relationship with, the fluiid, fourth means connected to the second and third means for flowing and recycling vapor from the first region to the lower pressure second region into heat transfer relationship with, but physically separate from the fluid and converting the vapor to a condensate in the lower pressure second region by heat transfer to the fluid whereby the fluid is heated, and fifth means connected to the second and third means for recycling condensate from the second region to the first region for reevaporation.

BRIEF DESCRIPTION OF THE DRAWINGS

The subject invention, as well as its various aspects and objects, will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 2:
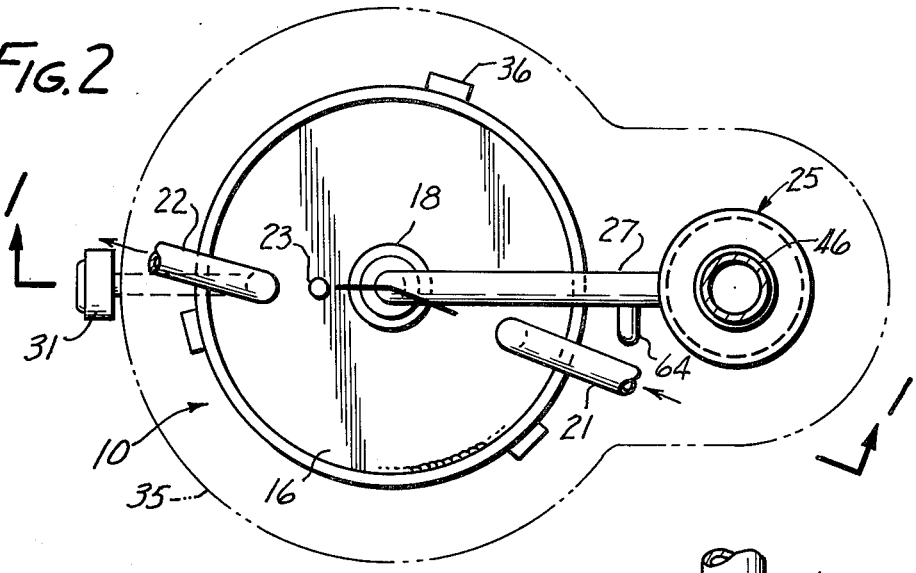
FIG. 2 is a top view of the apparatus shown in FIG. 1.

The fluid heating apparatus shown in the drawings are especially useful as domestic or industrial water heaters, but it should be understood that their utility is not so limited, but extends to the heating of water and other fluids in general.

Figure 1:
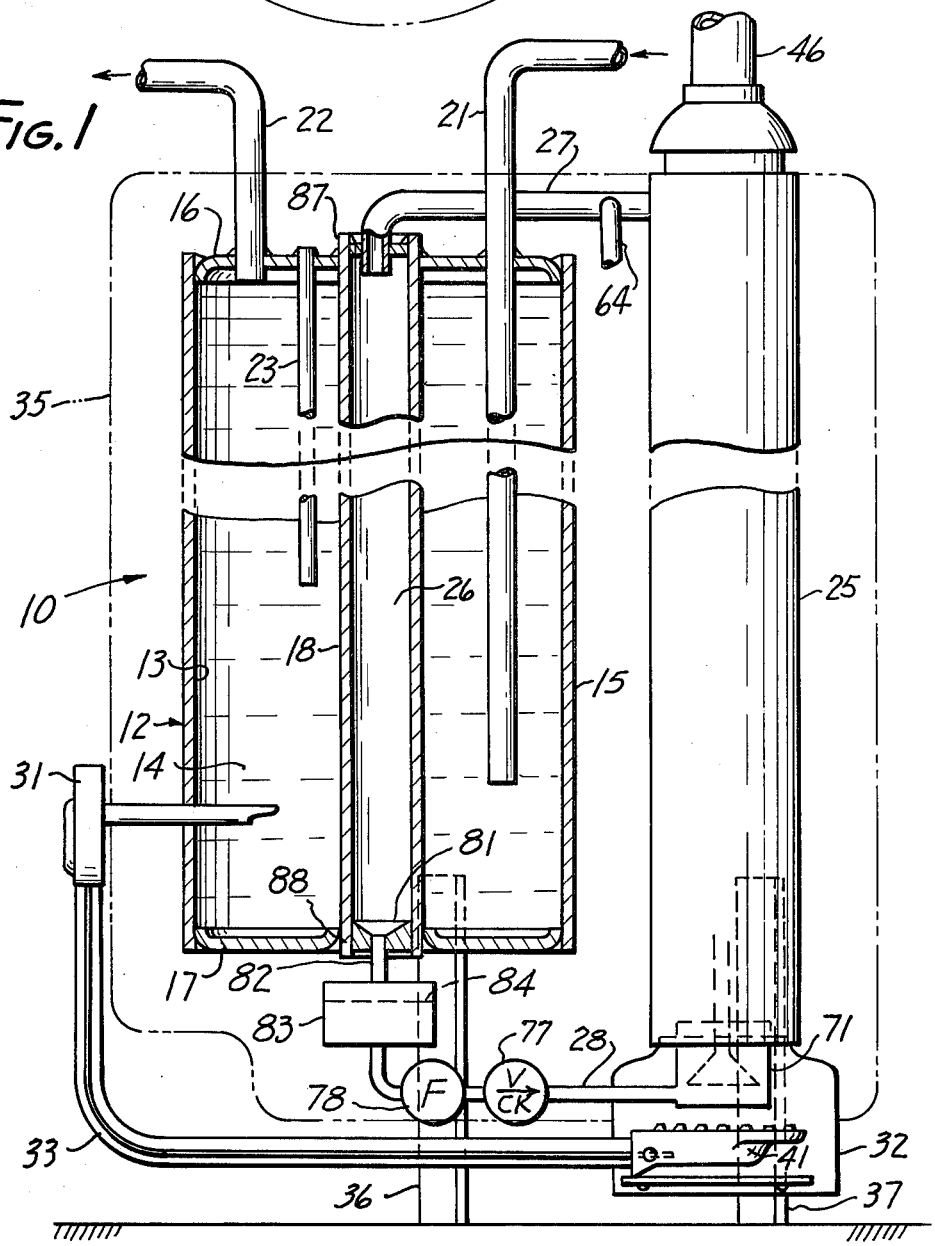
FIG. 1 is an elevation, partially in section, of a fluid of water heating apparatus in accordance with a preferred embodiment of the subject invention, taken along the line 1—1 in FIG. 2.
Figure 3:
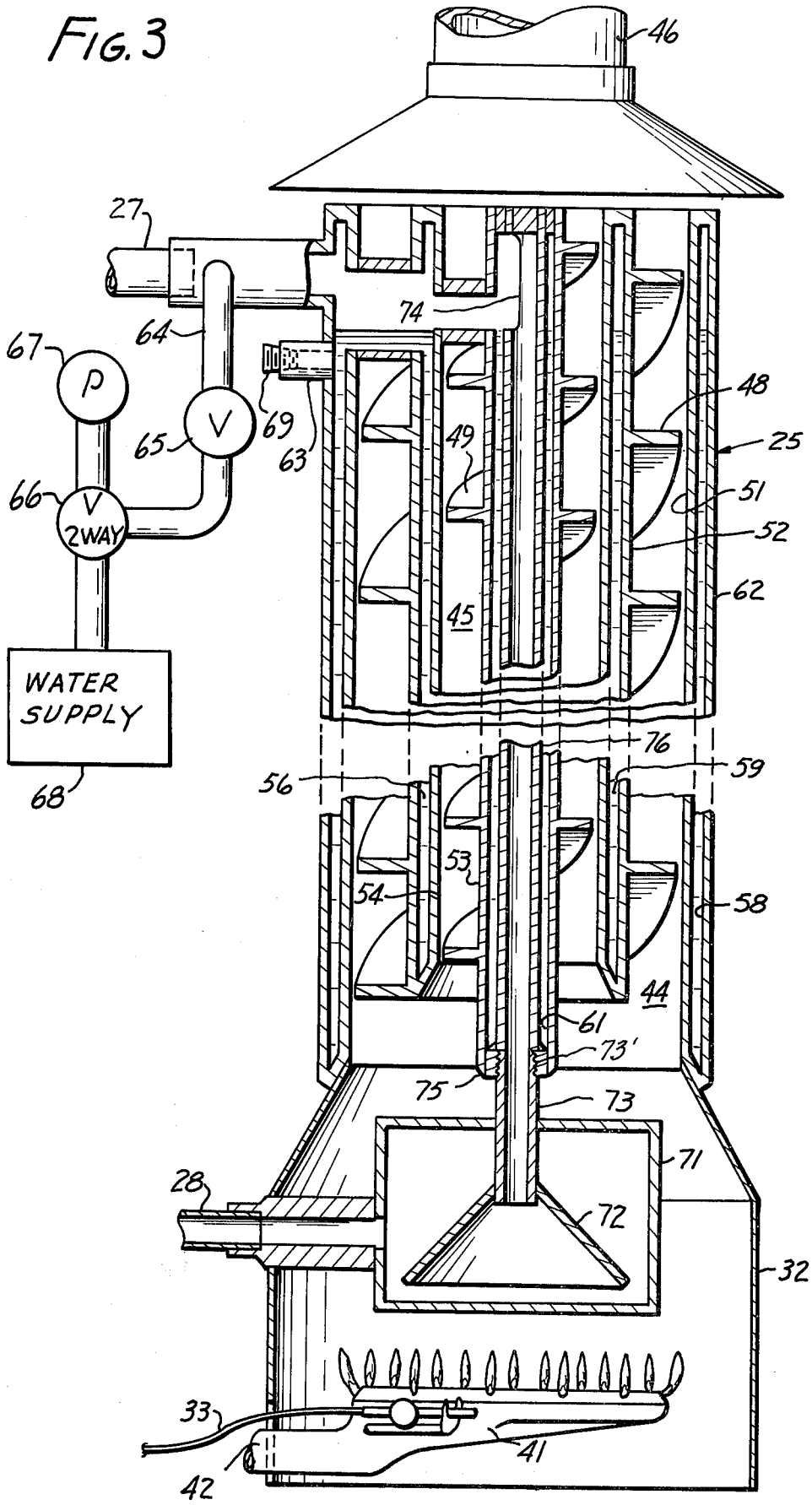
FIG. 3 is a longitudinal section, on an enlarged scale of one form of heater used in the apparatus of FIG. 1.

The heating apparatus 10 according to the preferred embodiment of the subject invention illustrated in FIGS. 1 to 3 has a tank 12 confining a space 13 for containing the fluid or water 14 to be heated and stored.

The tank 12 has a cylindrical shell 15 with top and bottom end plates 16 and 17, respectively.

A tube or pipe 18 extends through the tank 12 or space 13. In the illustrated preferred embodiments, the pipe 18 is concentric with the cylindrical shell 15 and extends through and between the end plates 16 and 17 so as to be surrounded by the water 14 in the tank.

The tank 12 also has a cold water inlet pipe 21 and a hot water outlet pipe 22, as well as a rod 23 of magnesium or other anodic material connected to, and extending into, the tank to inhibit corrosion. A heater apparatus 25 is situated in a first region located at a distance from the space 13 or tank 12 for receiving a condensate and for preparing from that condensate a vapor condensable through transfer of heat to the contained water in the tank 12.

The latter condensate is in effect a heat transfer medium which is heated to generate a vapor in the mentioned first region. In this process, the action of the heater apparatus 25 provides a vapor pressure in the mentioned first region with the generated vapor. On the other hand, the cooling effect of the water 14 in the space 13 provides in the pipe 18, by heat transfer to the contained water 14, a second region 26 of a pressure lower than the vapor pressure in the heater apparatus 25. The wall of the pipe 18 maintains the second region 26 physically separate from, but in heat transfer relationship with, the water 14. The pipe 18 may be of a durable metal or other heat-conductive material. The concentric position and shape of pipe 18 should not be considered limiting. This pipe or vapor receiving chamber may be positioned in any position passing through the water fill 14; it may be round, square, flattened, a double walled cylinder, or may be an outer shell surrounding tank 12 such that heat may be conducted into the water 14.

Piping 27 extends from the heater apparatus 25 into the top of the pipe 18 for flowing and recycling vapor from the first region in the heater apparatus 25 to the lower pressure second region 26 into heat transfer relationship with, but physically separate from, the water 14, whereby the temperature of the water 14 is increased and the vapor is reconverted to a condensate when contacting the walls of pipe 18 in the lower pressure second region 26 by heat transfer to the water 14. The pipe 18 extends through the space 13 in order to maintain the resulting condensate physically separate from the water 14 in the tank.

Piping 28 extends in the illustrated embodiment from the lower end of the vertical pipe 18 to the heater apparatus 25 for recycling condensate from the second region 26 to the first region for reevaporation by the heater apparatus 25.

The heater apparatus 25 continues to provide a vapor pressure in the first region, while the water 14 in the space 13 continues to provide a lower pressure second region 26. The vapor converted from recycled condensate by the heater apparatus 25 is recycled from the first region to the second region 26 into heat transfer relationship with, but physically separate from, the water, and is reconverted to a condensate as it contacts the internal wall of pipe 18 in that lower pressure second region 26. Such conversion of the vapor to a condensate is effected by heat transfer to the water 14 in the tank, whereby that water is heated.

The illustrated equipment continues to recycle condensate from the second region 26 to the first region at 25, to convert recycled condensate to vapor by heating in the first region, to recycle converted vapor from the first region to the second region, and to reconvert vapor to condensate in that second region 26 by heat transfer to the water 14, until the water 14 in the tank 12 has attained a desired temperature.

An adjustable thermostat 31 senses attainment by the water 14 of a predetermined temperature and correspondingly actuates a heating unit 32 via control lines 33.

The tank 12 is heavily heat insulated. In the illustrated preferred embodiments, both the tank 12 and the heater apparatus 25, as well as the piping 27 and 28, are surrounded by a heavy thermal insulation, as indicated in FIGS. 1 and 2 at 35. In contrast to the design of the most widely used type of gas water heater, there is no flue or riser for exhaust products extending through the tank 12.

This eliminates a major source of unavoidable heat losses, since such prior-art flue or riser presented a continuous heat sink to the hot water in the tank between heating cycles. Such a dissipation is not possible, since the principles of the subject invention permit the tank and adjacent parts to be completely surrounded by insulation.

Another reason why the above mentioned prior-art type of heat dissipation is inhibited resides in the fact that heat can only flow unidirectionally through the piping 27. In other words, the exchange of heat is undirectional from the heater apparatus 25 to the water 14.

For a fuller appreciation of this fact, it is advantageous to consider the heater apparatus 25, piping 27, condensing pipe 18, condensate drain pipe 82, condensate reservoir 83 and condensate return pipe 28, with filter 78 and check valve 77, as a heat pipe or heat pipe system. For brevity, the pipe 18 is sometimes referred to herein as a "heat pipe." However, it should be understood that the heat pipe actually includes the further parts mentioned in this paragraph.

In a classical heat pipe a vaporizable liquid or sold is contained in an evacuated and sealed pipe or closed system. If such pipe is tilted, such that one of its ends is lower than the other, condensate will, by force of gravity, flow to the lower end. If the pipe is sufficiently heated at that lower end, the condensate will begin to vaporize and pressure will increase inside the pipe.

The vapor thus created inside the pipe will migrate to the lowest pressure areas of the pipe interior.

Lower pressure areas exist where the pipe is cooler so that hot vapors common to those areas will be slightly cooled and will condense. The condensate will run down the pipe walls be force of gravity as mentioned above to the lower end which is being heated, and the condensate will again be vaporized.

This recycling of the condensate to vapor, the movement of the vapors to the cooler wall parts of the pipe, where the vapors will give up their latent heat of vaporization and condense, will bring up the temperature of the cooler areas until the pipe comes to be almost of the same temperature throughout its length.

By way of example, when water is vaporized at atmospheric pressure, it must absorb approximately 970 British Thermal Units (BTU) of heat energy for each pound of water vaporized. Again, when this vapor is slightly cooled and condenses, it must give up those 970 BTU of heat to the heat pipe walls. The vapors will move at high speeds to the cooler parts of the heat pipe because of the pressure differential in the pipe or heat pipe system.

This makes a heat pipe system perhaps the most efficient method of transferring heat energy, and a far greater heat flux density may be transferred by this method than by any other known technique.

It has been mentioned that about 10,000 times the amount of heat may be transferred by a heat pipe than by the conductance of a solid copper rod of equal diameter and length. Also, convection transfer of heat by the rising of heated water is many orders of magnitude smaller than that of a heat pipe, because heated water is only 4.2% lighter at 212° F. than it is at 38° F. and convection pressure is very low.

Even pumping water through a heated system and then through a cool system is till thermally inefficient in comparison to a heat pipe, and in addition the heat pipe is a passive method requiring no pump or other source of energy to cause the transfer.

In the heat pipe art, it is a well-known fact that a conventional heat pipe can transfer heat upwardly, but cannot transfer heat downwardly by more than few inches and not at all beyond a foot or more, even with a wick lined type of heat pipe which makes use of the capillary action of the wick for a return of the condensate to the source of the heat. Accordingly, an unlined heat pipe becomes an upward conducting medium and in effect becomes an upward conducting "heat check valve". This is of great importance in the practice of the subject invention, since the inventive method and apparatus effectively inhibit any significant dissipation of heat from the water 14 back through the piping 27.

In this regard, it should be noted that all condensate or heat transfer medium is constantly drained out of the area of pipe 18 which is in heat transfer relationship with the hot water 14. Between heating periods this condensate is not heated, by the heat of the stored water, and cannot create vapors that might rise in pipe 18 and pass through pipe 27 to cause cooling of the stored water.

It is thus seen that the heating methods and apparatus of the subject invention are not only concerned with an initial heating step as such, but extend into the area of heated fluid or hot water storage by providing systems in which heat delivered to the fluid cannot escape back through its channel of delivery as is the case with conventional water heaters and similar prior-art equipment.

The storage tank 12 and the heater apparatus 25 are mounted on legs, two of which are visible at 36 and 37 in FIG. 1.

A longitudinal section through the heater apparatus is shown on an enlarged scale in FIG. 3.

In particular, the heating unit 32 of the heater apparatus 25 is equipped with a gas burner 41 that is supplied with heating gas through piping 42. Of course, a gas burner is only shown by way of example, since other fuel burners, or electric heating elements, or any other suitable source of heat energy could be employed in the practice of the subject invention.

Hot gases, including products of combustion and heated air, rise from the burner unit 32 through hollow-cylindrical flue spaces 44 and 45 to and through a further flue or chimney 46.

Helical baffles 48 and 49 are located in the flue spaces 44 and 45 in order to cause the escaping gases to spin or rotate in intimate contact with adjacent cylindrical wall sections 51, 52, 53 and 54 for increased heat exchange therethrough.

The heater apparatus 25 contains a medium which is vaporizable by the heat generated by the burner 41 and which is condensable at the cooler regions 26 inside the heat pipe 18 surrounded by the fluid or water 14 to be heated and stored in a hot condition.

In practice, the medium or condensate 56 may be water that is converted to steam by the burner 41 in the heater apparatus 25. However, It should be understood that the present invention is not limited in its practice to the use of any one condensate or liquid medium.

For convenience and brevity, the medium or condensate 56 will herein after be referred to as water, and the spaces 58, 59 and 61 between the cylindrical wall section 51 and a cylindrical outer shell 62 of the heater apparatus 25, between the cylindrical wall sections 52 and 54, and inside the cylindrical wall section 53 will accordingly be referred to briefly as "water spaces".

Initially, the heater apparatus 25 is supplied or charged with water. To this end, the apparatus 25 has a vacuum and charging line 64 connected to the water spaces 58, etc. and provided with a shut-off valve 65.

The line 64 is alternatively connectible via a two-way valve 66 with a vacuum pump 67 and a water supply 68. The parts 66, 67 and 68 are for temporary service only while charging the heat transfer circuit and have no function in the normal operation of the heat pipe system. Also, the heater assembly 25 as shown in FIG. 3 is manufactured for conversion to other embodiments, as hereinafter described, and for this purpose has a pipe nipple 63 with a pipe plug 69 and further has a lift tube 73, a lower part of which is provided with a thread 73' to render that part detachable from the remainder of the lift tube '73 within the wall section 53. The detachable lift tube part is threaded at 73' into an annular plug 75 which not only mounts the lift tube relative to the tubular wall section, but also closes off the hollow cylindrical space between the lift tube and the cylindrical wall section 53 against an escape of water into the heating unit 32.

Initially, the valves 65 and 66 are adjusted so that the vacuum pump 67 is able to evacuate the pipes 18, 27, 28 and all water spaces 58 etc. or, in other words, to evacuate the inside of the heat pipe system. The value 66 is then adjusted so that the vacuum thus created can draw water from the supply 68 into the water spaces 58 etc., until the heating apparatus is sufficiently charged with water.

The cylindrical water jacket thus formed in the space 58 serves the important purpose of providing a store of water to be vaporized and of presenting an outside jacket of relatively low temperature as compared to the hotter parts of the heater apparatus, so that the heat insulation 35 surrounding the heater apparatus 25 need not be of a particularly high temperature/low efficiency type, but may be of a lower temperature/higher efficiency kind.

The previously mentioned piping 28 issues in the heating unit 32 into a pump chamber 71 which is disposed above the burner 41 and below the water jackets in the heater apparatus 25. The pump chamber 71 contains an inverted cone 72 which issues into the riser or lift tube 73 which, in turn, extends or rises through the cylindrical wall section 53 preferably to the level of the vapor piping 27, where it has an opening as shown at 74.

During the above mentioned charging operation, water is not only drawn by the previously established vacuum into the water spaces 58 and 59 and into the tube 53, but also through the opening 74 into the lift tube 73 and via cone 72 into the pump chamber 71. The two-way valve 66 is adjusted to reconnect the pump 67 to the inside of the system when the charging operation is completed to restore a vacuum in the heat pipe system. The valve 65 may then be closed to disconnect the charging unit from the system.

After the heater 41 has been turned on, water in the pump chamber 71 will become sufficiently heated for water to be converted into vapor or steam. Steam bubbles are caught by the cone 72 and start up the lift tube 73.

At this juncture it may be noted that the piping 28 contains a filter element 78 followed by a check valve 77 which prevents water and steam from flowing in the piping 28 backwardly in a direction away from the pump chamber and toward the heat pipe 18.

Accordingly, steam wil form in the upper part of the pump chamber 71 and when the steam or vapor pressure is greater than the water head pressure, lightened by the steam bubble lift in the riser tube 73, the water in the pump chamber 71 will be forced into the cone 72 and thence up the lift tube 73 to flow into any unfilled space adjacent or below the lift tube opening 74.

At that point, some of the water may even proceed into and through the piping 27.

After sufficient heating, steam will fill the cone 72 and lift tube 73 and equalize the pressure in the various parts of the heat pipe system after the water has been forced out of the lift tube 73. Heating of the stored water 14 has now begun in that steam issuing from the lift tube 73 via cutout 74 will enter the vapor piping 27 and issue into the heat pipe 18 in order to be condensed at the cooler low-pressure regions 26. It is to be noted that the steam or vapor will flow into heat transfer relationship with, but physically separate from, the stored water 14. Also, the heat pipe 18 and piping 28 will maintain the resulting water or condensate physically separate from the fluid or water 14 in the storage tank 12.

Condensed water running down the heat pipe 18 will be collected at the bottom thereof by a cone-like structure or plug 81 fitted into the lower end of the heat pipe 18. The condensed water further proceeds via a tube 82 into a condensate reservoir 83 where it accumulates as indicated by the liquid level 84.

As steam escapes from the pump chamber 71, pressure is relieved therein and accumulated condensate can pass from the reservoir 83 via filter 78 and check valve 77 through the piping 28 into the pump chamber 71.

This cooler water causes condensation in the chamber 71 which produces a partial vacuum in the upper chamber part whereby further condensate is pulled into the chamber 71 and refills same.

In the pump chamber 71, the recycled condensate is reheated by the burner 41 and the heating and evaporation cycle starts anew. In the meantime, the products of combustion and heated air rising through and spinning in the flue chambers 44 and 45 heat up the water jackets until water contained therein starts boiling. Steam thus produced passes up and out through the vapor piping 27 and pipe 18 in a true heat pipe fashion to be condensed therein.

In this manner, the condensate and the vapor are recycled. As an important feature, the mentioned heat pipe effect inhibits heat flow from the second region in the heat pipe 18 to the first region in the heater apparatus 25 contrary to the flow of vapor from the first region to that second region.

The above mentioned pump chamber action creates an underpressure or low-pressure area in the part of the first region occupied by the pump chamber 71 and condensate is pumped with that underpressure from the reservoir 83 adjacent the second region 26 back to the mentioned first region. In other words, a vacuum is provided in the mentioned first region and condensate is drawn into that first region with that vacuum, created intermittently for the desired pumping action.

As mentioned above, this is also the method with which condensate is initially drawn into the first region or pump chamber 71. If desired, condensate may also be recycled from the second region to the first region by way of gravity, as more fully described below.

The storage tank 12 may be disposed vertically, as shown in the drawings. However, the storage tank may also be positioned horizontally or in another position without departing from the spirit and scope of the subject invention. Also, the water jackets 58, 59 and/or 61 may be finned or replaced by coiled tubes rising in spirals without altering the concept of the invention. Conventional or desired safety valves and other features may be added to the installation.

In the illustrated preferred embodiment shown in FIGS. 1 and 2, the heat pipe 18 or second region 26 has opposite first and second end portions 87 and 88 and steam or water is flown to the second region 26 through the end portion 87. Condensate is then removed from the second region 26 through the second end portion 88 at the conical collector 81.

Apart from this illustrated preferred embodiment, it is also within the broad contemplation of the subject invention that steam or vapor be flown to the second region 26 through either of the first and second end portions 87 and 88.

Similarly, it is within the broad contemplation of the subject invention that vapor be flown to the second region 26 at a location between the first and second end portions 87 and 88.

Moreover, it is within the broad contemplation of the subject invention that condensate be removed from the second region 26 through one of the first and second end portions 87 and 88, as long as the pipe 18 is oriented to render this physically possible, while vapor is flown to the second region 26 at a location between the first and second end portion 87 and 88. Moreover, vapor may be flown to, and condensate removed from the second region 26 through one of the first and second end portions 87 and 88 as long as the pipe 18 is oriented to render removal of condensate through the particular end portion 87 or 88 physically possible.

Such modifications within the spirit and scope of the subject invention will now be described with the aid of FIGS. 4, 5 and 6 of the drawings, wherein the presence of heat insulation, such as the previously mentioned insulation 35, and of other identical parts or elements of the embodiment of FIGS. 1 to 3 will be presumed to be present but will not be shown for the sake of brevity and increased clarity of illustration.

Figure 4:
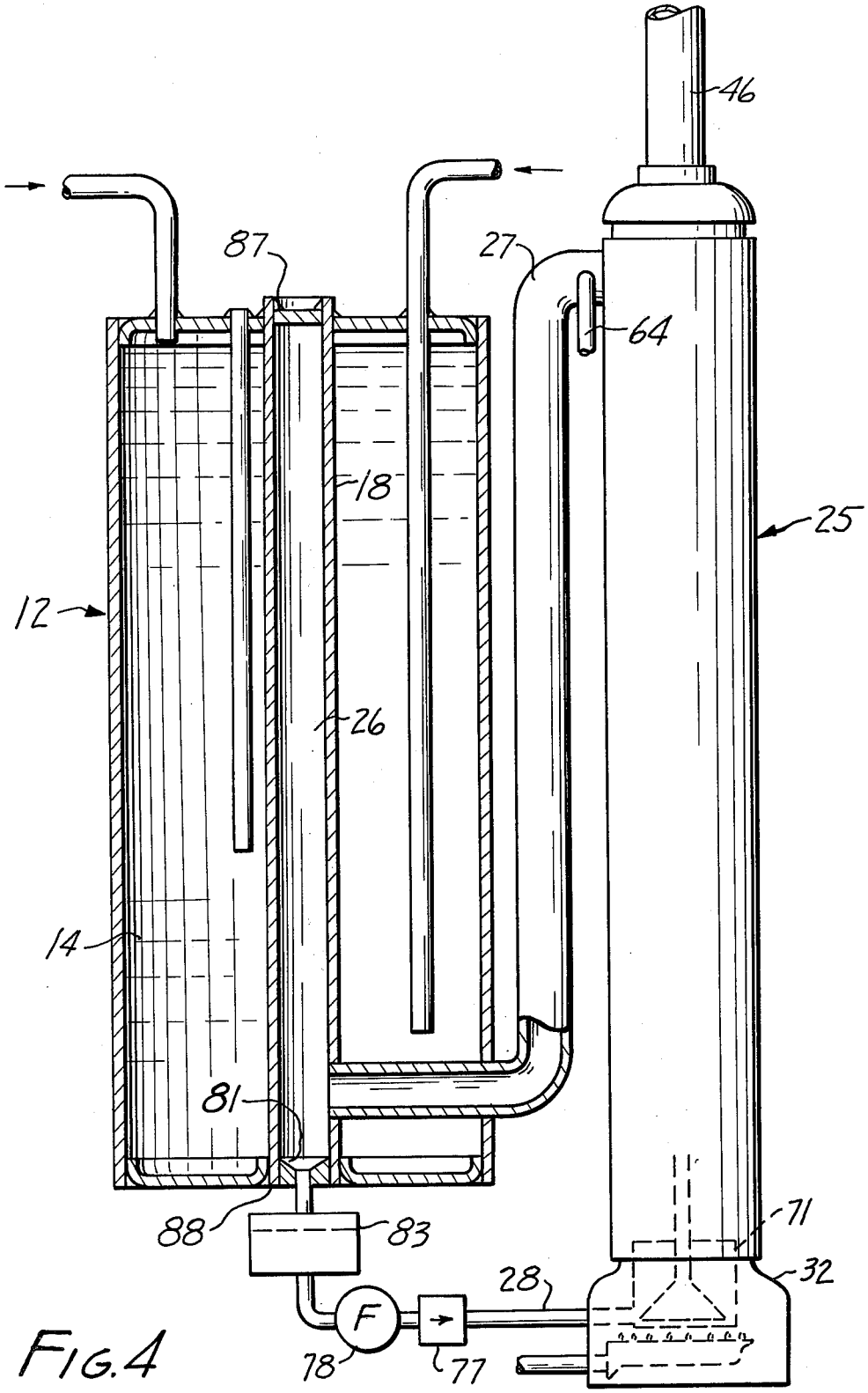
FIG. 4 is a view similar to FIG. 1, showing a modification of the heating apparatus in accordance with a further preferred embodiment of the subject invention.

According to FIG. 4, where like reference numerals as among FIGS. 1 to 4 designate like or functionally equivalent parts, the vapor piping 27 issues through part of the tank 12 into the heat pipe 18 somewhat above the end portions 88 of the pipe 18. Vapor following the heat pipe principle, will flow downward through the piping 27 and then upward through the pipe 18 to the cooler, low-pressure regions 26 in order to be condensed, thereby giving up heat to the stored water or fluid 14. With the exception of the shape of piping 27 and its entry into the pipe 18, this construction is the same as that of FIGS. 1 to 3.

The condensate will collect at 81 and will flow through the end portion 88, condensate reservoir 83, filter 78, one-way check valve 77 and piping 28 back to the heater apparatus 25.

In the embodiment in FIG. 5 where the heating apparatus 25 can be positioned below the lower end portion 88 of pipe 18, gravity flow may be used entirely to return the condensate through the condensate return pipe 28 to the heater 25 via the pipe nipple 63. To this end, the plug 69 shown in FIG. 3 is removed from the nipple 63 and the return pipe 28 is connected directly to that nipple.

No condensate reservoir 83, filter 78 or check valve 77 is necessary in this embodiment as condensate is constantly returned by gravity to the water spaces in heater 25, and no pump character 71 or lift tube 73 is required as the condensate return pipe 28 enters water space 58 near its upper end and will then flow downward into the other water spaces 59 and 61. The threaded connection between the lower part of tube 73 and annular plug 75 (see FIG. 3) allows easy removal of the lift pump mechanism consisting of parts 71, 72, and lower part of 73, which may be replaced by a standard pipe plug similar to the plug 69 to seal the lower end of the upper part of the lift pipe 73.

Figure 5:
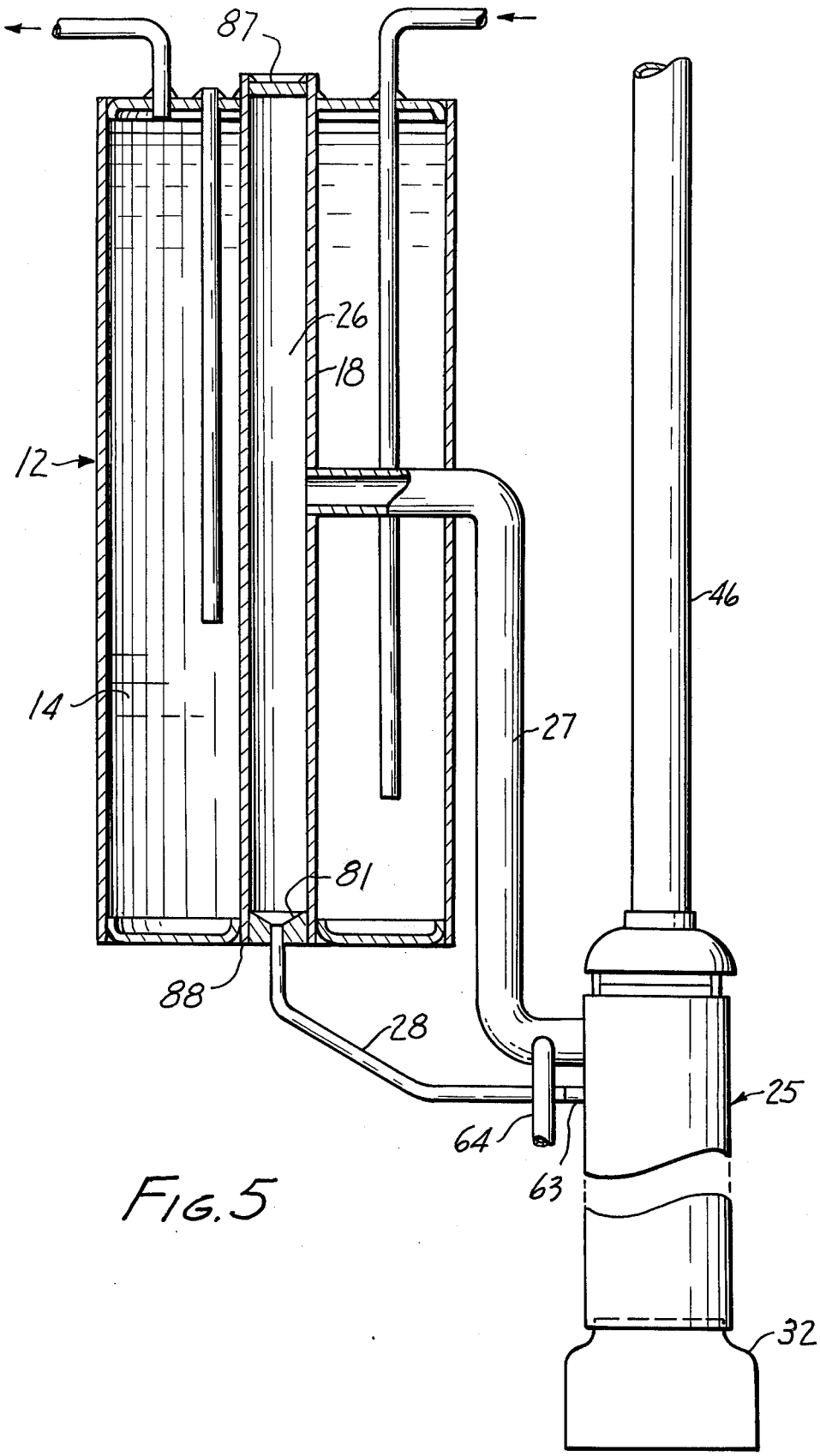
FIG. 5 is a view similar to FIG. 1, showing a further modification of the heating apparatus in accordance with yet another preferred embodiment of the subject invention.

The vapor transfer pipe 27 may enter the heat pipe 18 at any position above the lower end 88, or between the end portions 87 and 88, such as shown in FIG. 5 where it enters midway between the end portions.

Figure 6:
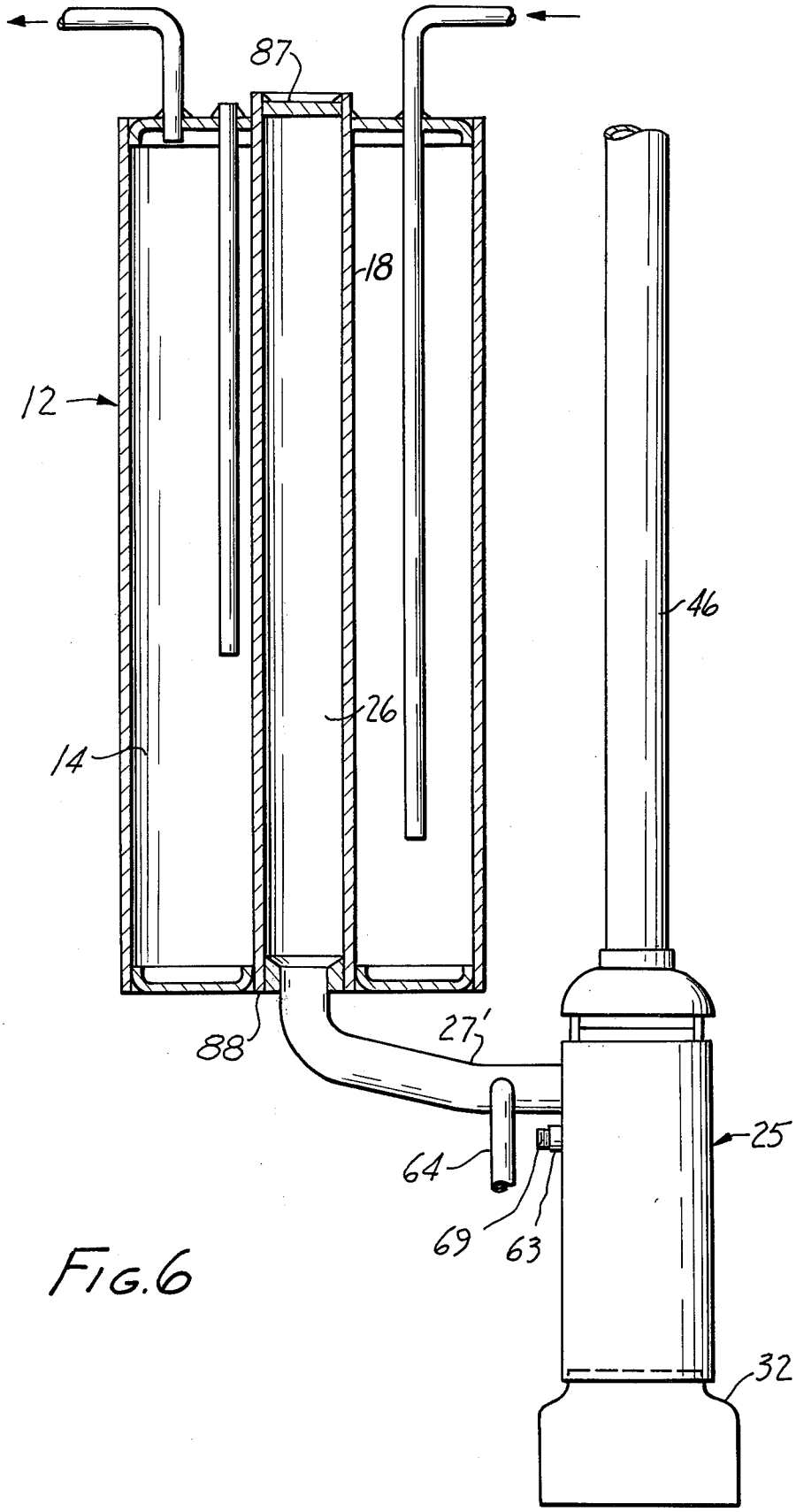
FIG. 6 is a view similar to FIG. 1, showing another modification of the heating apparatus in accordance with still a further preferred embodiment of the subject invention.

In the embodiment of the invention shown in FIG. 6, the vapor piping 27 and condensate piping 28 are unified into a piping 27' which is connected to the lower end portion 88 of the heat pipe 18 in the same manner as the condensate drain pipe 82 and to the heater apparatus 25 in the same manner as the vapor piping 27. In that case, vapor generated in the heater apparatus 25 flows through the piping 27' to the heat pipe 18 in order to be condensed in the region 26, whereby to heat the water 14 in the storage tank 12. The resulting condensate then returns by gravity flow through the piping 27' to the heater apparatus 25 to be reevaporated therein. The remainder of the embodiment of FIG. 6 is similar to that of FIG. 5, in that the gas burner 41 is present and utilized, but the pump chamber 71 with associated parts is removed.

It will thus be recognized that the invention meets all the initially mentioned objectives and provides fluid heating and storage systems which advantageously exploit the principle and high efficiency of heat pipe systems in order to put the energy of heating gas and similar thermal inputs to the highest possible use for the tasks at hand.

The subject extensive disclosure will suggest or render apparent various modifications and variations within the spirit and scope of the invention to those skilled in the art.

I claim:

1. A method of heating and storing a fluid, comprising in combination the steps of:

containing said fluid in a space;

heat insulating said space;

providing a vaporizable heat transfer medium;

heating said heat transfer medium in a first region located at a distance from said space to generate from said heat transfer medium a vapor condensable through transfer of heat to said contained fluid and providing a vapor pressure in said first region;

providing by heat transfer to said fluid in said space a second region of a pressure lower than said vapor pressure in said first region;

flowing said vapor to said lower pressure second region into heat transfer relationship with, but physically separate from, said fluid and converting said vapor to a condensate in said lower pressure second region by heat transfer to said fluid whereby said fluid is heated;

maintaining said condensate physically separate from said fluid;

transferring said condensate from said second region to said first region by means of the pressure differential therebetween;

converting said transferred condensate to vapor by reheating in said first region;

continuing to provide by heat transfer to said fluid in said space a lower pressure second region;

recycling said converted vapor from said first region to said second region into heat transfer relationship with, but physically separate from, said fluid and reconverting said vapor to a condensate in said lower pressure second region by heat transfer to said fluid whereby said fluid is further heated;

maintaining said reconverted condensate physically separate from said fluid;

continuing to transfer and recycle condensate from said second region to said first region, to convert recycled condensate to vapor by reheating in said first region, to recycle converted vapor from said first region to said second region, and to reconvert vapor to condensate in said second region, and to reconvert vapor to condensate in said second region by heat transfer to said fluid until said fluid has attained a desired temperature and inhibiting heat flow from said second region to said first region contrary to the flow of vapor from said first region to said second region.

2. A method as claimed in claim 1, including the step of:

pumping condensate from adjacent said second region back to said first region.

3. A method as claimed in claim 1, including the steps of:

intermittently providing a vacuum in said first region; and drawing condensate into said first region with said vacuum.

4. A method as claimed in claim 1, wherein:

condensate is recycled from said second region to said first region by force of gravity.

5. Apparatus for heating and storing a fluid, comprising in combination:

first means for containing and heat insulating said fluid;

second means spaced from said first means for receiving and heating a vaporizable heat transfer medium to generate a vapor in a first region located at a distance from said contained fluid and to provide a vapor pressure in said first region with said vapor;

third means at said first means for providing by heat transfer to said contained fluid a second region of a pressure lower than said vapor pressure in said first region and for maintaining said second region physically separate from, but in heat transfer relationship with, said fluid;

fourth means connected to said second and third means for flowing and recycling vapor from said first first region to said lower pressure second region into heat transfer relationship with, but physically separate from, said fluid and converting said vapor to a condensate in said lower pressure second region by heat transfer to said fluid whereby said fluid is heated;

fifth means connected to said second and third means for recycling condensate from said second region to said first region for reevaporation and means included in said third and fourth means for inhibiting heat flow from said second region to said first region contrary to the flow of vapor from said first region to said second region.

6. Apparatus as claimed in claim 5, wherein:

said fifth means include means for pumping condensate from adjacent said second region back to said first region.

7. Apparatus as claimed in claim 5, wherein:

said second means include means for intermittently providing in part of said first region an underpressure; and said fifth means include means for pumping condensate from adjacent said second region back to said first region by means of said underpressure.

8. Apparatus as claimed in claim 5, including:

means for intermittently providing a vacuum in said first region; and means for drawing condensate into said first region by means of said vacuum.

9. Apparatus as claimed in claim 5, wherein:

said fifth means include means for transferring said condensate from said second region to said first region by force of gravity for recycling said condensate.

10. Apparatus as claimed in claim 5, wherein:

said third means comprises a hollow cylinder vertically disposed within said first means and having opposite first and second end portions;

said fourth means include means for flowing and recycling vapor to said second region through said first end portion; and said fifth means include means for removing condensate from said second region through said second end portion.

11. Apparatus as claimed in claim 5, wherein:

said means for inhibiting heat flow comprises for inhibiting back flow of vapor and condensate.

12. Apparatus as claimed in claim 5, wherein:

said fifth means includes reservoir means for collecting condensate.

13. Apparatus as claimed in claim 12:

check valve means between said reservoir means and said first region for inhibiting back flow of condensate to said reservoir means.

* * * * *